US010307887B2

(12) United States Patent
Kountanya

(10) Patent No.: US 10,307,887 B2
(45) Date of Patent: Jun. 4, 2019

(54) SYSTEMS AND METHODS FOR DETERMINING A TOOL PATH FOR AUTOMATED FLEXIBLE FORK PEENING

(71) Applicant: United Technologies Corporation, Hartford, CT (US)

(72) Inventor: Raja Kountanya, Vernon, CT (US)

(73) Assignee: United Technologies Corporation, Farmington, CT (US)

( * ) Notice: Subject to any disclaimer, the term of this patent is extended or adjusted under 35 U.S.C. 154(b) by 643 days.

(21) Appl. No.: 15/096,641

(22) Filed: Apr. 12, 2016

(65) Prior Publication Data

US 2016/0221149 A1 Aug. 4, 2016

Related U.S. Application Data

(63) Continuation of application No. PCT/US2014/071192, filed on Dec. 18, 2014.

(60) Provisional application No. 61/924,500, filed on Jan. 7, 2014.

(51) Int. Cl.

| | |
|---|---|
| ***B21D 7/02*** | (2006.01) |
| ***B24C 1/10*** | (2006.01) |
| ***B21D 43/10*** | (2006.01) |
| ***B24B 39/00*** | (2006.01) |

(52) U.S. Cl.

CPC ..... *B24C 1/10* (2013.01); *B21D 7/02* (2013.01); *B21D 43/10* (2013.01); *B24B 39/006* (2013.01)

(58) Field of Classification Search

CPC ..... B24C 1/10; B24B 39/006; B21D 7/02; B21D 43/10

USPC ..... 72/75

See application file for complete search history.

(56) References Cited

U.S. PATENT DOCUMENTS

| | | | | |
|---|---|---|---|---|
| 5,033,005 | A | 7/1991 | Haske | |
| 5,091,861 | A | 2/1992 | Gellar et al. | |
| 5,815,399 | A | 9/1998 | Fujibayashi et al. | |
| 6,678,575 | B1 | 1/2004 | Graham et al. | |
| 7,219,044 | B1 * | 5/2007 | Prevey | G06F 17/50 703/7 |
| 7,237,417 | B2 * | 7/2007 | Wittig | B21H 8/00 72/214 |
| 7,600,404 | B2 * | 10/2009 | Prevey, III | B23P 9/00 72/11.1 |
| 8,121,720 | B2 | 2/2012 | Tsai | |
| 2013/0018616 | A1 | 7/2013 | El-Wardany et al. | |

OTHER PUBLICATIONS

International Preliminary Report on Patentability dated Jul. 12, 2016 in Application No. PCT/US2014/071192.

International Search Report and Written Opinion dated Mar. 26, 2015 in Application No. PCT/US2014/071192.

* cited by examiner

*Primary Examiner* — David B Jones

(74) *Attorney, Agent, or Firm* — Snell & Wilmer, L.L.P.

(57) ABSTRACT

Systems and method for tool path approximation may comprise approximating the outer surface of a part to be worked. The outer surface may be approximated by a plurality of airfoils. Moreover, the system and methods approximate a tool path based on a cutting tool and convert the tool path to accommodate a non-cutting processing tool. The tool path may be implemented on a computer numerically controlled machine that is configured to control a flexible fork peening tool.

19 Claims, 5 Drawing Sheets

SYSTEMS AND METHODS FOR DETERMINING A TOOL PATH FOR AUTOMATED FLEXIBLE FORK PEENING

CROSS-REFERENCE TO RELATED APPLICATIONS

This application is a continuation of, claims priority to and the benefit of, PCT/US2014/071192 filed on Dec. 18, 2014 and entitled "SYSTEMS AND METHODS FOR DETERMINING A TOOL PATH FOR AUTOMATED FLEXIBLE FORK PEENING," which claims priority from U.S. Provisional Application No. 61/924,500 filed on Jan. 7, 2014 and entitled "SYSTEMS AND METHODS FOR DETERMINING A TOOL PATH FOR AUTOMATED FLEXIBLE FORK PEENING." Both of the aforementioned applications are incorporated herein by reference in their entirety.

FIELD

The present disclosure relates to approximation of tool paths, and more specifically, to systems and methods for automatically controlling a flexible fork peening tool along an approximated tool path.

BACKGROUND

Turbo machinery blades are typically peened as part of their finish processing. The peening process may condition and improve material properties of the blade, and in particular, the edge of the blade. Peening may be a cold work process that induces compressive stresses and/or relieves tensile stresses present in a blade. Peening may also induce strain hardening in the surface of the metal being worked (e.g., a blade edge).

SUMMARY

In various embodiments, a method for defining a tool path may comprise defining, by a computer based system for defining a tool path, curve boundaries of a surface of an airfoil for an interval length on a first side of the airfoil and a second side of the airfoil; creating, by the computer based system, drive surfaces on the first side and the second side based on the defined curve boundaries; creating, by the computer based system, a first tool path on the first side for a barrel tool; defining, by the computer based system, a second tool path for the second side of the airfoil; converting, by the computer based system, the first tool path for a zigzag motion to a pinching motion; and synthesizing, by the computer based system, the first tool path based on a geometry of a processing tool.

In various embodiments, a system may comprise a flexible fork peening tool and a computer numerically controlled (CNC) machine. The flexible fork peening tool may be coupled to the CNC machine. The flexible fork peening tool may be constrained from rotating about its vertical axis. The CNC machine may be configured to move the flexible fork peening tool along a tool path. The tool path may be an approximation of a part to be worked.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the inventions, it should be understood that other embodiments may be realized and that logical, chemical and mechanical changes may be made without departing from the spirit and scope of the inventions. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Figure 1:
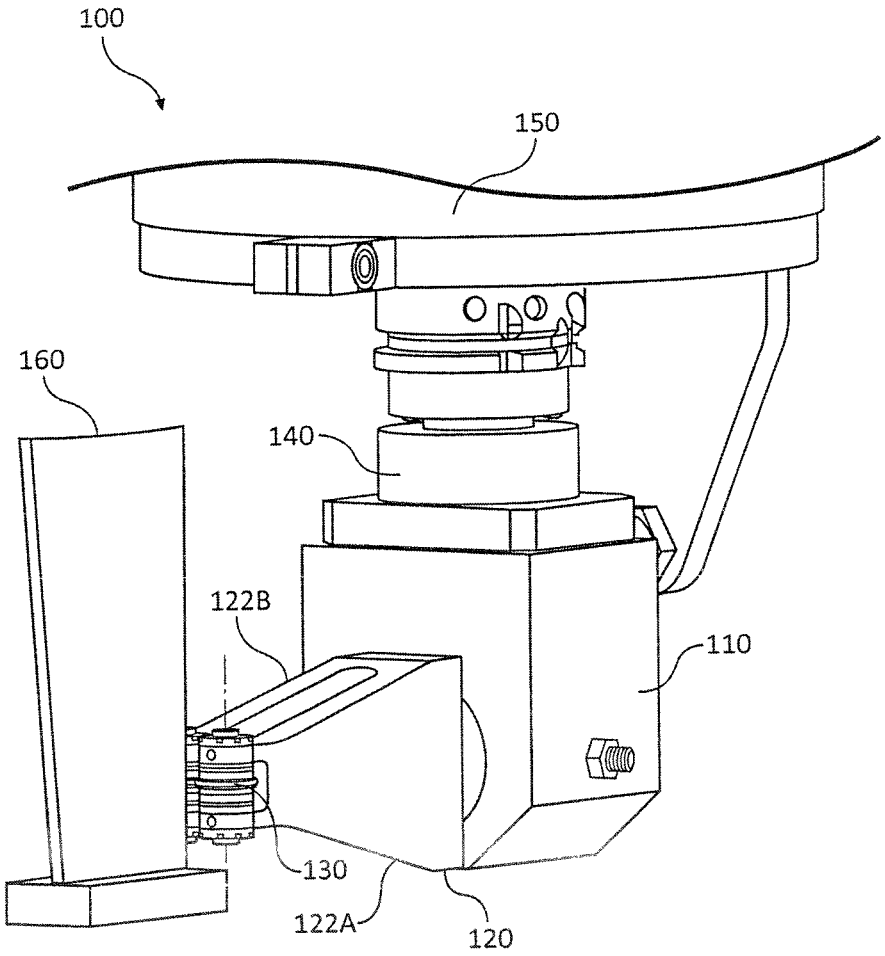
FIG. 1 illustrates a flexible fork peening tool installed on a portion of a 5-axis machine engaging a part to be worked, in accordance with various embodiments.

In various embodiments and with reference to FIG. 1, a flexible fork peening tool 100 may comprise a body 110, a fork 120, one or more rollers 130 and an attachment device 140. Fork 120 may comprise a first arm 122A and a second arm 122B. A first roller 130 may mount to an end of first arm 122A and a second roller 130 may mount to a second arm 122B. Flexible fork peening tool 100 may be capable of being mounted to a typical metal processing machine computer numerical control ("CNC") machine 150. In this regard, flexible fork peening tool 100 may be adapted to and used to peen and/or process parts with existing machinery.

Figure 2:
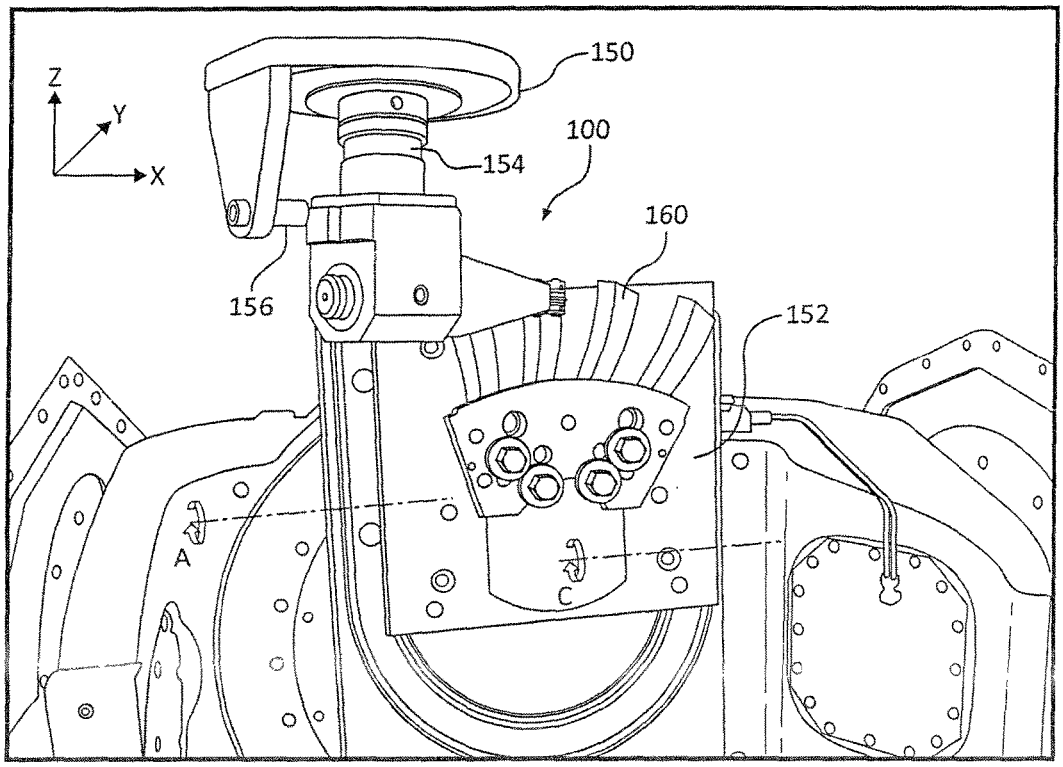
FIG. 2 illustrates a flexible fork peening tool installed on a portion of a 5-axis machine engaging a part to be worked that is attached to a portion of the 5-axis machine, in accordance with various embodiments.

In various embodiments and with reference to FIG. 2, machine 150 may be, for example, a 5-axis machine. Machine 150 may comprise a machine table 152, a spindle 154, and a stabilizing roller 156. Machine table 152 may be configured to hold and/or retain blade 160. Blade 160 may be oriented with respect to machine table 152 in any suitable fashion. For example, blade 160 may be mounted to machine table 152 in an orientation that reduces and/or minimizes rotation of spindle 154. More specifically, mounting blade 160 may be coaxial with machine table 152 minimizing the rotation of spindle 154 for peening operations.

In various embodiments, Machine 150 may have and/or be configured to control 5 degrees of freedom. Machine 150 may be configured to and/or capable of linear motion in the X, Y, and Z direction (e.g., three degrees of freedom). Machine 150 may also be capable of and/or configured to rotate in direction A about an axis collinear with machine table 152 and to rotate in direction C about an axis perpendicular to machine table 152. In this regard, machine 150 may be commanded to move in each of the X, Y, Z, A, and C directions.

In various embodiments, flexible fork peening tool 100 may also be installed on and/or used with a robot. The robot may have features that provide it with more degrees of freedom than a 5-axis machine.

Figure 3:
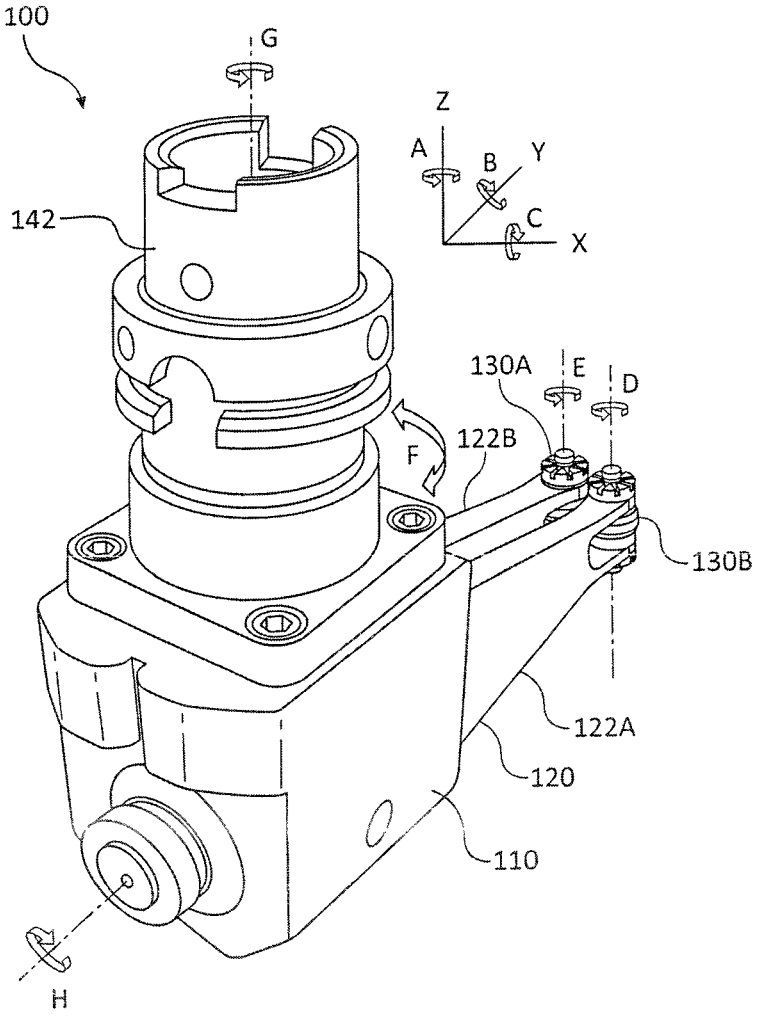
FIG. 3 illustrates a flexible fork peening tool, in accordance with various embodiments.

In various embodiments and with reference to FIG. 3, flexible fork peening tool 100 has a total of 11 degrees of freedom relative to blade 160. In this regard, the flexible fork peening tool 100 is capable of liner motion in the X, Y, and Z directions. Flexible fork peening tool 100 is also capable of rotational motion in direction A about the Z-axis, direction B about the Y-Axis, and direction C about the X-axis. First roller 130A may be capable of rotational motion E about its centerline. Similarly, second roller 130B may be capable of elongational motion F (e.g., a flex of and between first arm 122A and second arm 122B). Flexible fork peening tool 100 may be capable of rotational motion H about a centerline of body 110. Flexible fork peening tool 100 may be capable of rotational motion F. Flexible fork peening tool 100 may be capable of rotational motion G about a centerline of body 110. In this regard, motion F is the only non-rigid motion of flexible fork peening tool 100 and/or machine 150.

In various embodiments and with reference to FIGS. 2 and 3, flexible fork peening tool 100 may be fixed with respect to rotational movement about the Z-axis (shown as rotational motion A in FIG. 3) to allow the spindle 154 of machine 150 (e.g., a spindle) to spin, though the flexible fork peening tool 100. Spinning the spindle 154 without allowing flexible fork peening tool 100 to rotate may cause the bearings in spindle 154 to be loaded properly. Spindle 154 may be removably attachable to chuck 142 of flexible fork peening tool 100. In this regard, spindle 154 may drive chuck 142, causing both spindle 154 and chuck 142 to rotate and/or spin. Stabilizing roller 156 may contact and/or stabilize flexible fork peening tool 100. In this regard, the rotation of spindle 154 and chuck 142 may cause flexible fork peening tool 100 to vibrate, move, and/or rotate. Stabilizing roller may contact a portion of flexible fork peening tool 100 to minimize and/or dampen the effect of the rotation of spindle 154 and chuck 142 on flexible fork peening tool 100. Contact by rollers 130A and 130B of blade 160 may also minimize and/or dampen the effect of the rotation of spindle 154 and chuck 142 on flexible fork peening tool 100.

Figure 4:
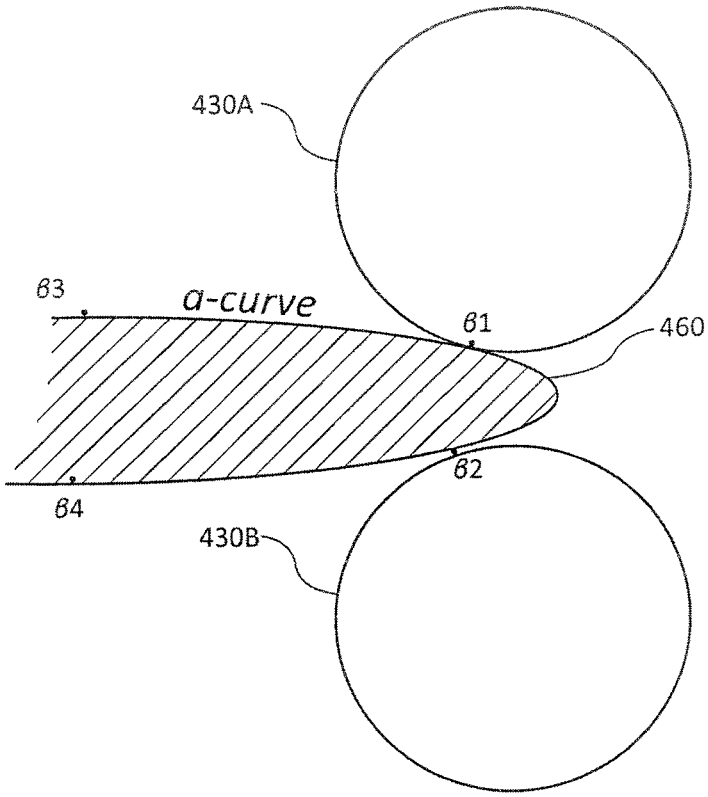
FIG. 4 illustrates an approximation of a cross-section of an blade and/or vane, in accordance with various embodiments.
Figure 5:
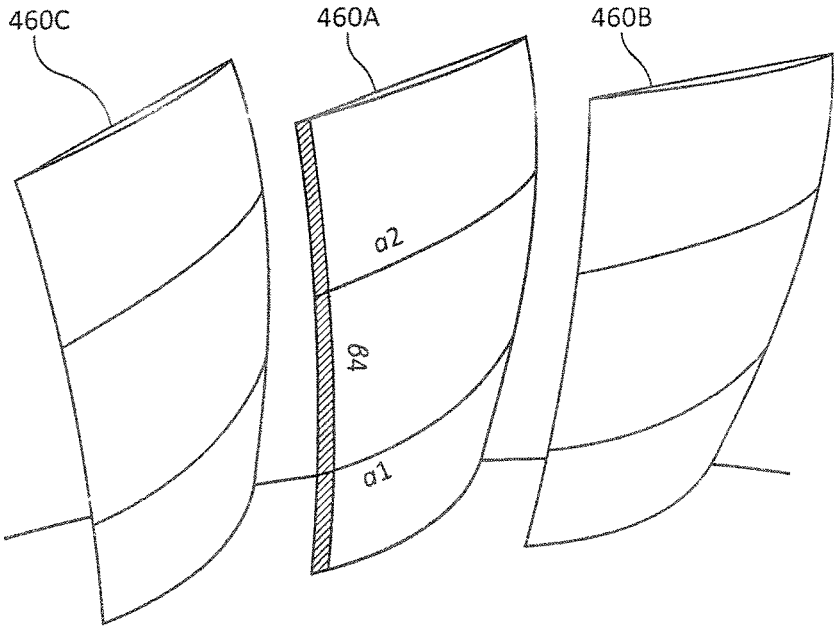
FIG. 5 illustrates approximations of an outer surfaces of a plurality of blades and/or vanes, in accordance with various embodiments.

In various embodiments, blade 160 may be approximated by one or more complex three-dimensional surfaces. It may also be approximated parametrically using a plurality of airfoils. With reference to FIGS. 1 and 4-5, a cross section of blade 160 (as shown in FIG. 1) may be approximated and/or represented by a cross sectional portion of blade model 460. Cross sectional portion of blade model 460 may be an airfoil. Moreover, the outer surface of blade 160 may be approximated by a plurality of cross sections corresponding to various radial locations relative to the axis of rotation connected by stringers (e.g. ($\beta$4), as shown in FIG. 5. In this regard, blade model 460 (shown as 460A, 460B and 460C in FIG. 5) may determine and approximate the twist of blade 160 at every radial location of the blade between the blade root and the blade tip, as shown in FIG. 5. The cross sectional portion of blade model 460 may be approximated by an $\alpha$ curve. Various points along the curve may have $\beta$ locations. For example and as shown in FIG. 4, the $\alpha$ curve approximates the outer surface of the portion of the cross section shown and the various points $\beta$1, $\beta$2, $\beta$3 and $\beta$4 along the $\alpha$ curve. Each of the various points $\beta$1, $\beta$2, $\beta$3 and $\beta$4 may correspond to a stringer that approximates a curve and/or bend between the root and the tip of blade model 460.

Figure 6:
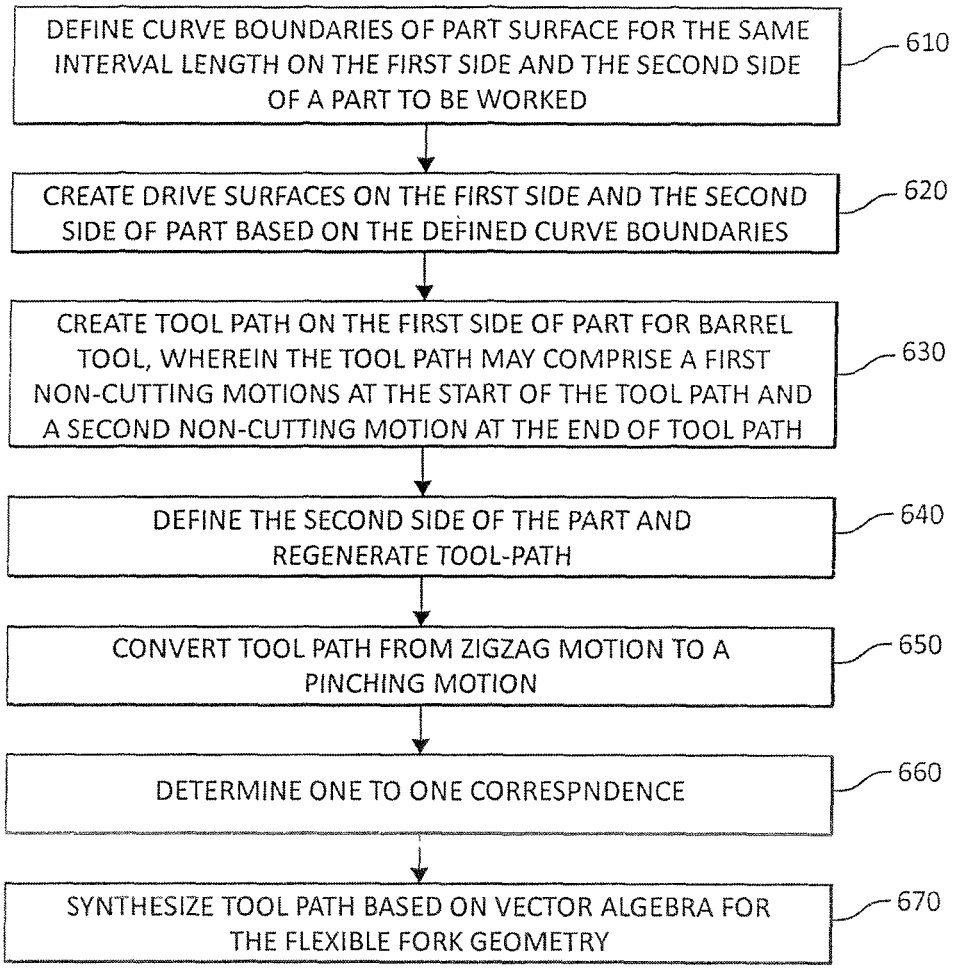
FIG. 6 is a process flow for defining a tool path along a portion of an outer surface of a blade and/or vane, in accordance with various embodiments.

In various embodiments and with reference to FIGS. 4-6, blade model 460 may be a function of $\beta$ and $\alpha$ and as a result may provide a basis for a method of determining a tool path for peening a part to be worked with a flexible fork peening tool. In this regard, the tool path may include both processing and non-processing motions. More specifically, blade model 460 may define curves of the airfoil surface ($\alpha$-curve) (Step 610). Each side of the surface (e.g., the right side of blade model 460 and the left side of blade model 460) may be bounded by a depth $\beta$ (e.g., the depth $\beta$3 on a first side and the depth $\beta$4 on a second side, as shown in FIG. 4).

More specifically, to create the boundary curves for the surfaces, a point on the airfoil that corresponds to $\alpha=\beta=0$ is defined (noting that $\beta=0=1$ represents the same point since the cross section of blade model 460 are defined as closed curves in a [0, 1] interval). An $\alpha$ curve may be defined along each side of the cross section of blade model 460, between equally spaced values of $\beta$ (e.g., in values of $\Delta\beta$). For example, the $\alpha$ curve may be defined along each side of the cross section of blade model 460 at $\beta$1, $\beta$3, $\beta$2 and $\beta$4. The length along the blade model 460 (e.g., the portion of blade model 460 between the root and tip of the model) may be bound by selected $\alpha$ curves (e.g., $\alpha$1–$\alpha$2 as shown in FIG. 5). Values of $\alpha$1 and $\alpha$2 may be determined based on the length along which the peening is desired and the bounding values of $\beta$ that determine the depth of the peening, as shown in FIG. 5.

In various embodiments, the method of determining a tool path may create drive surfaces on the first side and the second side of the airfoil approximation based on the defined curve boundaries (Step 620). These drive surfaces may establish a one-to-one correspondence between the first and second side of blade model 460.

In various embodiments, the method of determining a tool path may create a tool path on the first side of the airfoil for a barrel tool (Step 630). The tool path may comprise one or more first non-cutting motions at the start of the tool path and one or more second non-cutting motions at the end of the tool path. More specifically, transporting the control point along the axis of the tool, but retaining the same axial orientation may accomplish the transformation from a barrel style tool path to a roller style tool path. In various embodiments, the method of determining a tool path may define a second side of the airfoil and re-generate a tool path for the second side (Step 640). This step may result in a small but negligible variation in the peen depth along blade 160, as shown in FIG. 1.

In various embodiments, the method of determining a tool path may convert the tool path from a zigzag motion to a pinching motion (Step 650). In this regard, the tool path defined and approximated by the method discussed herein may include steps between a first α curve and a second α curve on either side of the blade edge. Given the engagement style (e.g., pinching flexible forks), the tool path may be converted from a tool path for a traditional traversing style tool (e.g., a cutting tool) to a tool path for a pinching style tool (e.g., pinching flexible forks). In this regard, a standard cutter may move in a zigzag motion. However, the flexible fork peening tool described herein may need to translate along a transverse linear path with respect to blade 160 (as shown in FIG. 1) e.g., and not a zigzag path.

In various embodiments, the method of determining a tool path may determine a one to one correspondence between the first side of the part and the second side of the part (Step 660). The surface, curve and corresponding distance between β1 and β3 may not be equal to the surface, curve and corresponding distance between β2 and β4. In this regard, there may be a first number of steps (e.g., machine 150 movements or cutting step approximations) and/or a first length between β1 and β3 and a second number of steps (e.g., machine 150 movements or cutting step approximations) and/or a second length between β2 and β4. This distance and/or number of steps may be normalized. This normalization may result in there being a one-to-one correspondence between the peening movements of a first roller 430A and a second roller 430B.

In various embodiments, this normalization may be determined by any suitable process. For example, the first length and/or first number of steps may be compared to the second length and/or second number of steps, to determine a minimum value. The minimum value may be used. In operation, the tool path of first roller 430A and second roller 430B would be the same distance and/or the same number of steps between β1 and β3 and β2 and β4, respectively, regardless of the actual length and/or number of steps between β1 and β3 and β2 and β4. In various embodiments, the normalized (e.g., unbiased) tool path with one to one correspondence on each side of the blade 460 may minimize and/or limit twisting in the blade 460.

In various embodiments, the method of determining a tool path may synthesize the tool path based on vector algebra for the flexible fork geometry (Step 670). In this regard, there is one-to-one correspondence between first roller 430A and first side of blade model 460 and second roller 430B and second side of blade model 460. The radius of the flexible fork peening tool (e.g., the distance from the centerline of attachment device 140 to the centerline of roller 130, as shown in FIG. 3). While there may be no exact way to move the flexible fork peening tool so that both rollers 430 are constrained the same way, the flexible fork peening tool may be equally biased by both rollers 430 (e.g., roller 430A and roller 430B). In this regard, the tool path may use the midpoint of the respective tool path for the first and the second side of blade model 460 and the average tool inclination for every contact location. This may keep rollers 430 equally inclined to the surfaces the rollers 430 are touching (e.g., the first side and the second side of blade model 460 in the approximation and blade 160 in operation).

In various embodiments, the systems and methods for tool path approximation may be used in connection with any suitable peening operation in any suitable application including, for example, sheeting metal processing, forging, rolling, and/or the like.

In various embodiments, the steps and corresponding tool path approximation described herein may be implemented, modeled, approximated and/or determined on any suitable computer using various software modules, processors, and/or the like.

In various embodiments, setting of the angle of the caliper tool during the initialization of the peening process. In this regard, the lateral orientation of the flexible fork in the X-Y plane relative to the machine may be known. This angle may be deduced by the lateral coordinates of the approximated tool paths of the first roller and second roller at the beginning of a peening process.

The systems and method described herein may be implemented on any suitable machine capable of holding and moving the flexible fork peening tool. A machine with little to no spindle rotation and/or a locking spindle may limit vibration and/or incidental movement of the flexible fork peening tool in operation.

In various embodiments, the methods described herein are implemented using the various particular machines described herein. The methods described herein may be implemented using the any suitable particular machines, and those hereinafter developed, in any suitable combination, as would be appreciated immediately by one skilled in the art. Further, as is unambiguous from this disclosure, the methods described herein may result in various transformations of certain articles.

In various embodiments, the embodiments are directed toward one or more computer systems capable of carrying out the functionality described herein. The computer system includes one or more processors, such as processor. The processor is connected to a communication infrastructure (e.g., a communications bus, cross over bar, or network). Various software embodiments are described in terms of this exemplary computer system. After reading this description, it will become apparent to a person skilled in the relevant art(s) how to implement various embodiments using other computer systems and/or architectures. Computer system can include a display interface that forwards graphics, text, and other data from the communication infrastructure (or from a frame buffer not shown) for display on a display unit.

Conventional data networking, application development and other functional aspects of the systems (and components of the individual operating components of the systems) may not be described in detail herein. The various system components discussed herein may include one or more of the following: a host server or other computing systems including a processor for processing digital data; a memory coupled to the processor for storing digital data; an input digitizer coupled to the processor for inputting digital data; an application program stored in the memory and accessible by the processor for directing processing of digital data by the processor; a display device coupled to the processor and memory for displaying information derived from digital data processed by the processor; and a plurality of databases. Various databases used herein may include: client data; merchant data; financial institution data; and/or like data useful in the operation of the system. As those skilled in the art will appreciate, user computer may include an operating system, as well as various conventional support software and drivers typically associated with computers.

The computer systems may also include a main memory, such as for example random access memory (RAM), and may also include a secondary memory. The secondary memory may include, for example, a hard disk drive and/or a removable storage drive, representing a floppy disk drive, a magnetic tape drive, an optical disk drive, etc. The removable storage drive reads from and/or writes to a removable storage unit in a well-known manner. Removable storage unit represents a floppy disk, magnetic tape, optical disk, etc. which is read by and written to by removable storage drive. As will be appreciated, the removable storage unit includes a tangible, non-transitory computer usable storage medium having stored therein computer software and/or data.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the inventions. The scope of the inventions is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A method comprising:

defining, by a computer based system for defining a tool path, curve boundaries of a part surface for an interval length on a first side of the part and a second side of the part;

creating, by the computer based system, drive surfaces on the first side and the second side based on the defined curve boundaries;

creating, by the computer based system, a first tool path on the first side for a barrel tool;

defining, by the computer based system, a second tool path for the second side of the airfoil;

converting, by the computer based system, the first tool path for a zigzag motion to a pinching motion;

determining, by the computer based system, a one to one correspondence between the first side and the second side; and synthesizing, by the computer based system, the first tool path based on a geometry of a processing tool.

2. The method of claim 1, wherein the first tool path may comprise a first non-cutting motion at the start of the tool path and a second non-cutting motion at the end of tool path.

3. The method of claim 1, wherein the processing tool is a flexible fork peening tool.

4. The method of claim 1, wherein the processing tool is capable of being mounted on and moved by a computer numerically controlled machine.

5. The method of claim 1, wherein the computer numerically controlled machine is a 5-axis machine.

6. The method of claim 1, wherein the 5-axis machine has a locking spindle.

7. The method of claim 1, wherein the first tool path aligns the processing tool with a surface of a part to be worked.

8. The method of claim 1, further comprising defining, by the computer based system, a plurality of curve boundaries for a plurality of airfoil surfaces.

9. The method of claim 8, further comprising defining a first point and a second point along the curve boundary.

10. The method of claim 9, wherein the first point and the second point define a depth the processing tool will move relative to the part to be worked.

11. A system comprising:

a computer numerically controlled (CNC) machine comprising a spindle configured to spin about a rotational axis, a flexible fork peening tool comprising a chuck, wherein the chuck of the flexible fork peening tool is removably coupled to the spindle of the CNC machine, wherein the flexible fork peening tool is constrained from rotating about the rotational axis of the spindle, and wherein the CNC machine is configured to move the flexible fork peening tool along a first tool path that is an approximation of a part to be worked.

12. The system of claim 11, wherein the CNC machine is a 5-axis machine with 5 degrees of freedom.

13. The system of claim 12, wherein the flexible fork peening tool has a first degree of freedom comprising elongation motion between a first arm and a second arm, a second degree of freedom comprising rotational motion about a first centerline of a body, a third degree of freedom comprising rotational motion about a second centerline of the body.

14. The system of claim 11, wherein the flexible fork peening tool comprises a first roller and a second roller.

15. The system of claim 14, further comprising:

a processor in electronic communication with the CNC machine; and a tangible, non-transitory memory configured to communicate with the processor, the tangible non-transitory memory having instructions thereon that, in response to execution by the processor, cause the processor to perform operations comprising:

defining, by the processor, curve boundaries of a part surface for an interval length on a first side of the part to be worked and a second side of the part to be worked;

creating, by the processor, drive surfaces on the first side and the second side based on the defined curve boundaries;

creating, by the processor, the first tool path on the first side for the first roller;

defining, by the processor, a second tool path on the second side for the second roller;

converting, by the processor, the first tool path from a zigzag motion to a pinching motion;

determining, by the processor, a one to one correspondence between the first side and the second side; and synthesizing by the processor, the first tool path based on a geometry of a processing tool, wherein the first tool path insures substantially uniform contact of the first roller and the first side, wherein the second tool path insures substantially uniform contact of the second roller and the second side.

16. The system of claim 13, wherein the spindle spins the chuck.

17. The system of claim 16, wherein the CNC machine further comprises a stabilizing roller pin that is configured to contact a portion of the flexible fork peening tool in response to the spindle spinning about the rotational axis.

18. The system of claim 17, wherein the stabilizing roller pin is configured damp a vibration of the body of the flexible fork peening tool in response to the contact between the stabilizing roller pin and the portion.

19. The system of claim 14, wherein at least one of the first tool path or the second tool path is defined by a plurality of airfoils that approximate the part surface.

* * * * *